US005156314A

United States Patent [19]

Wallace

[11] Patent Number: 5,156,314

[45] Date of Patent: Oct. 20, 1992

[54] APPARATUS FOR PRESENTING BLIND RIVETS

[75] Inventor: John Wallace, Birmingham, England

[73] Assignee: Avdel Systems Limited, A British Company, Welwyn Garden City, England

[21] Appl. No.: 701,029

[22] Filed: May 16, 1991

[30] Foreign Application Priority Data

May 23, 1990 [GB] United Kingdom ..... 9011495

[51] Int. Cl.[5] ..... B21J 15/10

[52] U.S. Cl. ..... 227/107; 227/112; 221/239

[58] Field of Search ..... 227/52, 55, 107, 112, 227/119, 135, 139; 221/278, 224, 239; 29/243.521; 72/391.6

[56] References Cited

U.S. PATENT DOCUMENTS 4,005,519 2/1977 Di Maio et al. ..... 227/55
4,592,136 6/1986 Hirsch .
4,747,294 5/1988 Schwartz et al. ..... 227/112
4,765,175 8/1988 Denham et al. ..... 72/391

FOREIGN PATENT DOCUMENTS 2118086 10/1983 United Kingdom .

*Primary Examiner*—Frank T. Yost
*Assistant Examiner*—Allan M. Schrock
*Attorney, Agent, or Firm*—Oblon, Spivak, McClelland, Maier & Neustadt

[57] ABSTRACT

Apparatus for presenting blind rivets (11) of the type comprising a shell (12) and a projecting stem (13), one at a time for pick-up by the nosepiece (28) of a rivet setting tool, includes gate means comprising a pair of guide members (24) for receiving a rivet (11) blown by air along a hose (39). The guide membes are urged by a spring (25) into their closed position, in which they arrest each rivet and position it in uniform orientation with its stem (13) projecting. Locating means (30) receives the nose piece (28) and guides it into the correct position and orientation for picking up the rivet by its projecting stem. A proximity detector (37) detects when the tool nose tip is correctly located, and actuates a pneumatically driven plunger (18) which pushes the guide members (24) apart to release the rivet into the tool nosepiece (28).

4 Claims, 3 Drawing Sheets

APPARATUS FOR PRESENTING BLIND RIVETS

BACKGROUND OF THE INVENTION

The invention relates to apparatus for presenting blind rivets, of the type comprising a shell and a projecting stem, for pick-up by the nosepiece of a rivet setting tool, which apparatus comprises;

a passage along which rivets are fed one at a time stem foremost;

gate means arranged to arrest each rivet and position it in uniform orientation at a pick-up location;

locating means for locating the nosepiece of a setting tool in predetermined relation to the gate means with the mandrel-receiving aperture of the nosepiece in a position to receive a rivet stem from the gate means at the pick up location;

which gate means comprises a pair of guide members movable with respect to each other.

Apparatus of this type is disclosed GB 2 118 086, in which the guide members of the gate are spring-biassed into the open position, and are closed to receive a rivet only when a tool nosepiece contacts the gate means and is forced towards the guide members, closure against the spring biassing being produced by the force and movement of the setting tool. This reliance on force and movement by the setting tool may be acceptable in some circumstances, for example where the rivet setting tool is hand held and may be freely moved about by an operator who can exert the necessary force on the tool manually. However, it is now increasingly the practice to mount such rivet setting tools in fixed position, which requires that workpieces in which rivets are to be set, and the rivet presenting apparatus, are alternately brought to the setting tool nosepiece. It is also increasingly the practice to mount such rivet setting tools on a movable or articulated mechanical positioning device, such as a robot arm. In such cases, the prior-art arrangement referred to may have disadvantages.

SUMMARY OF THE INVENTION

Accordingly, the present invention provides apparatus for presenting blind rivets, of the type comprising a shell and a projecting stem, for pick-up by the nosepiece of a rivet setting tool, which apparatus comprises;

a passage along which rivets are fed one at a time stem foremost;

gate means arranged to arrest each rivet and position it in uniform orientation at a pick-up location;

locating means for locating the nosepiece of a setting tool in predetermined relation to the gate means with the mandrel-receiving aperture of the nosepiece in a position to receive a rivet stem from the gate means at the pick up location;

which gate means comprises a pair of guide members movable with respect to each other and which when in closed abutting engagement with each other to define a funnel in which a rivet emerging from the said passage will be brought to rest at the pick-up location with its stem confined by the narrow end of the funnel;

and gate-opening means comprising plunger movable to open the gate means and allow a rivet held thereby to be released for transfer to the nosepiece of the tool;

in which the guide members are resiliently urged into closed abutting engagement with each other as aforesaid, and by means including moving the plunger to open the gate means when the tool nosepiece is located as aforesaid in relation to the gate means, while the tool nosepiece remains stationary in relation to the gate means.

Preferably the gate-opening means includes detection means for detecting the presence of the tool nosepiece in the aforesaid predetermined relation to the gate means, and actuating means, responsive to the detection means for moving the plunger to open the gate means.

BRIEF DESCRIPTION OF THE DRAWINGS

Other features of the invention will become apparent from the following description of one embodiment of the invention. In the accompanying drawings.

DETAILED DESCRIPTION OF THE PREFERRED EMBODIMENTS

Figure 1:
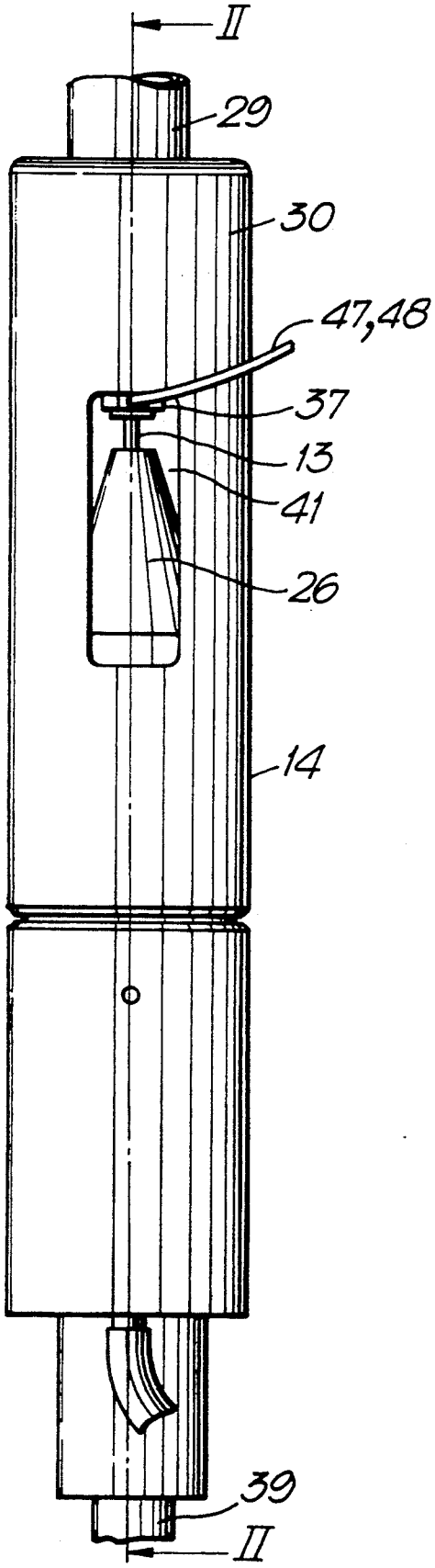
FIG. 1 is an outside elevation of the presenting apparatus.

The apparatus of this example is intended to present a succession of rivets such as the one shown at 11 which comprises a shell 12 and a stem 13 which projects from the shell. Such rivets are well known in many countries under the registered trademark AVEX.

The apparatus comprises a rigid tubular body 14 which, in this example, is made from two tubular parts screwed together to locate between them a bearing 15. Inside the tubular body is mounted for limited reciprocation a tubular plunger 16 containing an axial passage 17 along which rivets are fed, one at a time and stem foremost, by a stream of air. The outside of the plunger slides in the bearing 15, and the rearward end of the plunger is enlarged to form a piston 18 sliding within the rear end part of the body. A helical compression spring 19 urges the plunger 16 rearwardly in the body until the piston 18 abuts a stop flange 21. Compressed air can be admitted to the rear of the body by means of a port 22, thereby providing actuating means for moving the plunger forwardly against the urging of spring 19. The forward end of the tubular plunger 16 is formed with an external taper 23.

Figure 2:
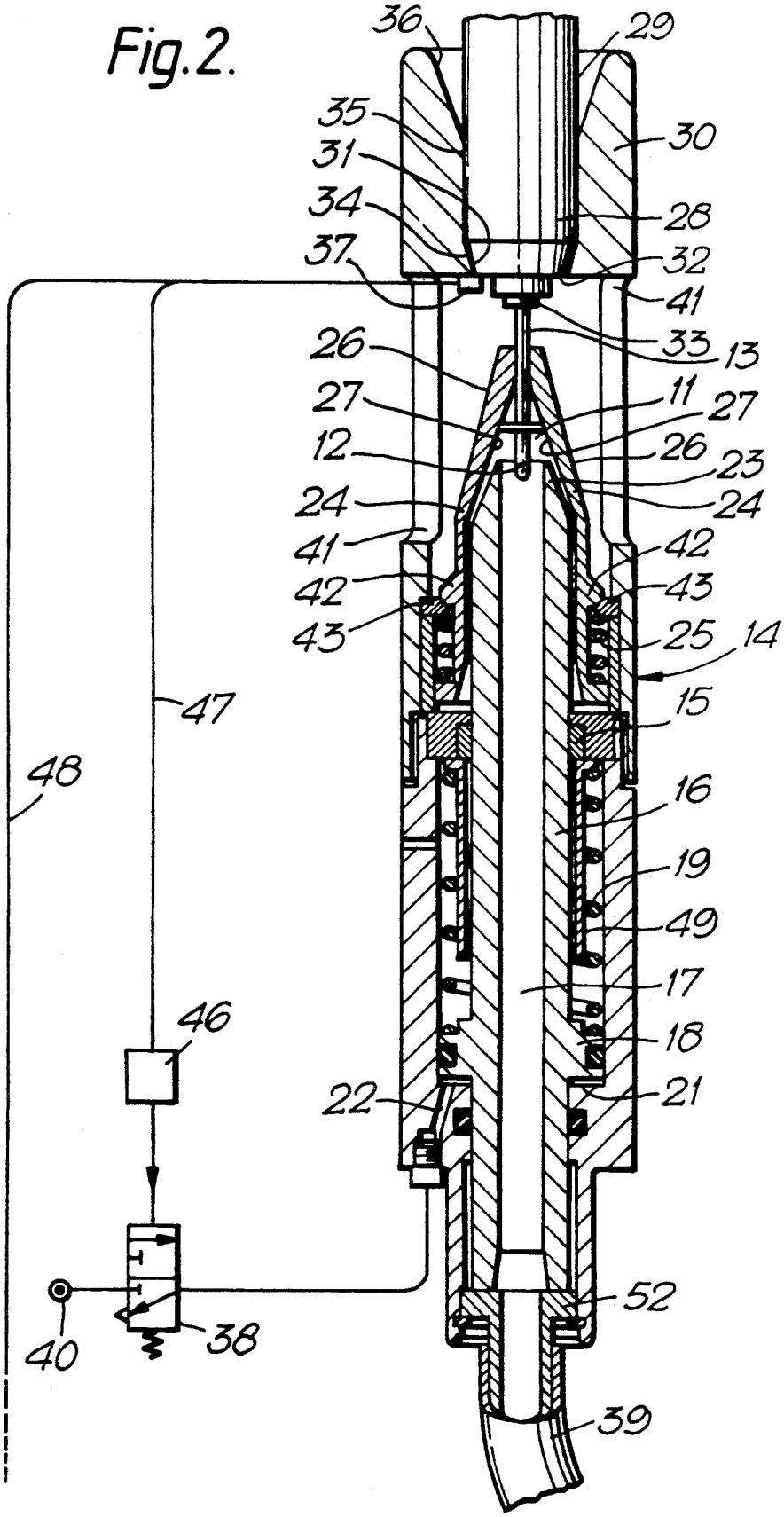
FIG. 2 is an axial section on the line II—II of FIG. 1 through the presenting apparatus with the gate means closed (including a rivet for the purpose of illutration only)

The gate means comprises a pair of guide members 24, 24 within the forward part of the body 14. These are mirror images of each other, each being generally semi-tubular. The are urged rearwardly by means of a helical compression spring 25. Each guide member is shaped with a projection 42 which engages with a projection 43 inside the body. The shapes of the projections are such that the rearward urging of the spring 25 urges the forward ends of the guide members towards, and into contact with, each other. Their forward ends are tapered externally at 26 and internally at 27. Forwards of the internal taper 27 each guide member is provided with a flat face 44 which, when the guide members are closed together, abuts the corresponding face 44 of the other guide member. Each flat face 44 is formed with a semi-cylindrical groove 45, so that when the faces 44, 44 are in contact with each other, the two grooves 45, 45, together form a bore of the correct diameter to receive and locate the stem 13 of a rivet. As illustrated in FIG. 2, when the guide members 24 are closed together, their internal tapers 27 together with the bore formed by the grooves 45, 45 define a funnel in which a rivet 11 emerging from the passage 17 at the forward end of the plunger 16 will be brought to rest, with its shell 12 abutting the tapers 27 and its stem 13 projecting through the bore formed by the grooves 45, 45 at the front end of the tapers, at a pick-up location which is in pre-determined relationship with the body 14. The bore formed by the grooves 45, 45 is sufficiently long that the stem of a rivet emerging from the forwards end of the guide members is correctly aligned to enter into the anvil aperture 33 of a setting tool correctly located in the tool locating means, as described below.

At the forward end of the body 14 is provided locating means 30 for locating the nosepiece 28 of a rivet-setting tool (the remainder of which is not shown in the Figures). The shape of the nosepiece has a cylindrical exterior 29 terminating in a short taper 31 and an end face 32 in the centre of which is an anvil aperture 33 which receives the stem 13 of a rivet. The nosepiece locating means is provided with locating surfaces which mate with those on the nosepiece, namely a locating taper 34 which mates with the nosepiece taper 31, and a cylindrical locating face 35 which mates with the nosepiece cylindrical face 29. The forward end of the cylindrical face 35 is provided with a lead-in taper 36 to facilitate entry of the nose tip into the locating means 30. As illustrated in FIG. 1, when the nosepiece 28 is fully located in the locating means 30, the anvil aperture 33 receives the stem 13 of a rivet 11 entering the gate means under the guidance of the guiding members and held in the pick-up location.

The apparatus includes detection means, for detecting the presence of the tool nosepiece in the correct position in the locating means 30, in the form of a detector 37, which may for example be a microswitch, or an optical or inductive proximity detector. It is arranged to give an output signal (which may be electrical or pneumatic) to indicate when the nosepiece 28 is fully located in the locating means 30. The detector 37 is connected via line 47 to control, via delay means 46 (which is electrical or pneumatic, according the type of output signal from the detector 37), to a two-port two-way air valve 38 which controls the admission of compressed air from a compressed air inlet 40 to behind the piston 18 to actuate the plunger 16. The detector is also connected via line 48 to actuate a rivet feeding device (not shown) situated at a convenient position to feed one rivet at a time, stem foremost, along a rivet feed hose 39 attached to the rear end of the body 14 by a swivel connection 52.

The body 14 is provided with opposed apertures 41, 41 opposite the pick-up location of the rivet. These enable visual inspection of the guide members and the rivet, and possibly access to those elements if necessary.

The configuration of the rivet presentation apparatus is initally as illustrated in FIG. 2, with the air valve 38 closed, the plunger 16 held in its lowermost position by the spring 19, and the guide members 24, 24 held closed together by their spring 25. The nose taper 23 on the plunger 16 is slightly spaced away from the internal tapers 27, 27 on the guide members. The nosepiece 28 of a tool would not normally be in the locating means 30, nor would a rivet 11 be in the pick-up location defined by the members 24. These are shown in FIG. 2 only for the purposes of illustration.

Figure 3:
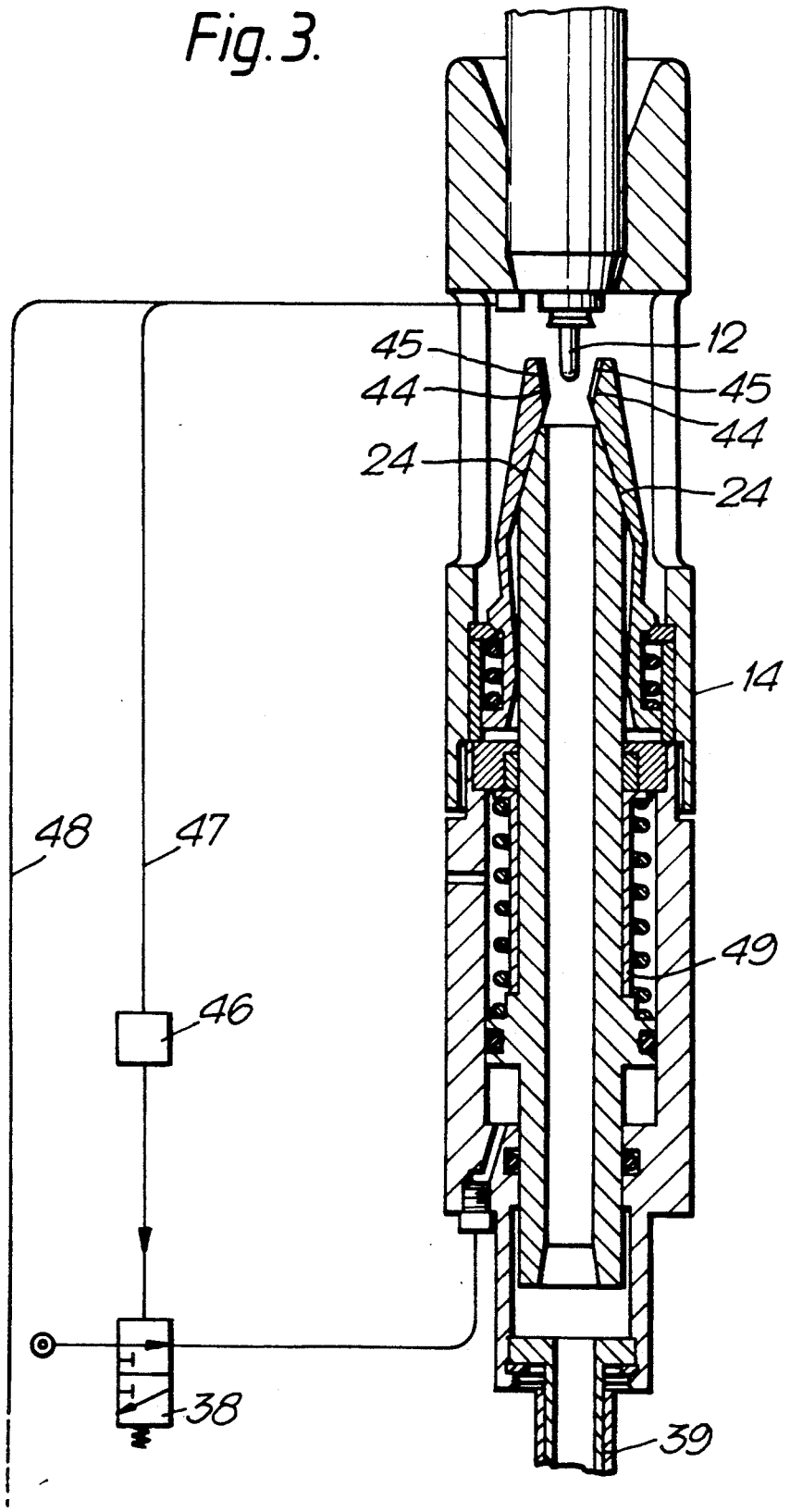
FIG. 3 is similar to FIG. 2, but shows the gate means open.

When it is required to pick up a rivet in the riveting tool, the tool nosepiece is inserted into the locating means 30 until its surfaces mate with the corresponding surfaces of the locating means. The detector 37 then detects the presence of the nosepiece, located in predetermined relation to the gate means and also therefore in predetermined relation to the pick-up location. The output of the detector actuates the rivet feeding device previously referred to. A rivet is released into the hose 39 and travels, stem foremost, under the influence of a stream of air along the hose 39, into the passage 17 inside plunger 16, and forwards until it is arrested and held by the guide members 24, in the pick-up location, as previously described and as actually illustrated in FIG. 2. The stem of the rivet is centralized by the tapered faces 27, 27 to enter the bore formed by the grooves 45, 45 so that the end part of the stem enters the anvil aperture 33 of the nosepiece. After a pretermined delay provided by the delay device 46, which is at least long enough to allow the rivet from the feeding device to reach the pick-up location, the output from the detector 37 opens the air valve 38, which drives the plunger 16 forwards to a position determined by stop collar 49. The taper 23 on the front of the plunger contacts the internal tapers 27, 27 on the guide members and forces the guide members 24 apart against the biassing of the spring 25, sufficiently to release the rivet 11 into the nose piece, under the urging of the air stream along the hose 39 and bore 17. The rivet stem further enters the anvil aperture 33 until the rivet shell head abuts the anvil. The rivet is held there by the action of a stream of air being sucked into the anvil aperture due to an air flow stem ejector system in the rivet setting tool. This is the position illustrated in FIG. 3.

The tool is then withdrawn from the presenting apparatus carrying the rivet with it. Removal of the tool is detected by detector 37, which actuates valve 38 to allow the plunger 16 to return under the urging of spring 19. The guide members 24 close together again under the urging of spring 25, ready to receive a further rivet.

The invention is not restricted to the details of the foregoing example.

For instance, it could be arranged that a rivet is fed to and held in the pick-up location before the tool nosepiece is inserted into the presenting apparatus. The cylindrical locating face 35 in the nose piece locating means 30 is sufficiently long that the anvil aperture 33 is guided in the correct alignment to receive the stem 13 of a rivet already held in the pick-up location as the nosepiece is inserted into the location means and approaches the correct final location. The delay means 46 is omitted, so that when the detector 37 detects the correct location of the nosepiece in the locating means, it actuates the opening of the gate means without delay.

Feeding of a single rivet along the hose 39 to the presenting device may be achieved by initiating an air blast to a rivet previously released into the hose and lying stationary at the bottom of bend in the hose.

I claim:

1. Apparatus for presenting blind rivets, of the type comprising a shell and a projecting stem, for pick-up by the nosepiece of a rivet setting tool, which apparatus comprises:

a passage along which rivets are fed one at a time with the stems foremost;

gate means for arresting each rivet and positioning it in uniform orientation at a pick-up location;

locating means for locating the nosepiece of a setting tool in predetermined relation to the gate means with the mandrel-receiving aperture in the nosepiece in a position to receive a rivet stem from the gate means at the pick-up location;

which gate means comprises a pair of guide members movable with respect to each other and which when in closed abutting engagement with each other define a funnel in which a rivet emerging from the said passage will be brought to rest at the pick-up location with its stem confined by the narrow end of the funnel;

gate-opening means comprising a plunger movable to open the gate means and allow a rivet held thereby to be released for transfer to the nosepiece of the tool;

resilient urging means for resiliently urging the guide members into closed abutting engagement with each other; and means for moving the plunger to open the gate means when the tool nosepiece is located in the predetermined relation to the gate means, while the tool nosepiece remains stationary in relation to the gate means.

2. Apparatus as claimed in claim 1, in which the gate-opening means includes detection means for detecting the presence of the tool nosepiece in the aforesaid predetermined relation to the gate means, and actuating means, responsive to the detection means, for moving the plunger to open the gate means.

3. Apparatus as claimed in claim 1 wherein said plunger is hollow and defines a portion of said passage.

4. Apparatus as claimed in claim 3 wherein said plunger has a tapered nose positionable in said funnel, and wherein said tapered nose engages said guide members at said funnel when said plunger moves to open said gate means.

* * * * *